US011229566B2

(12) United States Patent
Lam et al.

(10) Patent No.: US 11,229,566 B2
(45) Date of Patent: Jan. 25, 2022

(54) TWO-PLANE, FOLDING PATIENT ASSIST HANDLE

(71) Applicant: Arjo IP Holding AB, Malmo (SE)

(72) Inventors: Vincent Lam, San Antonio, TX (US); Thomas Anthony Dellaca, San Antonio, TX (US); Jennifer Farrell, Austin, TX (US)

(73) Assignee: Arjo IP Holding AB, Malmo (SE)

( * ) Notice: Subject to any disclaimer, the term of this patent is extended or adjusted under 35 U.S.C. 154(b) by 839 days.

(21) Appl. No.: 16/003,631

(22) Filed: Jun. 8, 2018

(65) Prior Publication Data

US 2019/0374418 A1 Dec. 12, 2019

(51) Int. Cl.
*A47C 21/08* (2006.01)
*A61G 7/053* (2006.01)

(52) U.S. Cl.
CPC ..... *A61G 7/053* (2013.01)

(58) Field of Classification Search
CPC ..... A61G 7/053; A61G 7/0518; A47C 21/08
See application file for complete search history.

(56) References Cited

U.S. PATENT DOCUMENTS

D199,957 S 1/1965 Bertoldo
3,423,057 A * 1/1969 Iverson ..... A47B 23/06 248/296.1
4,932,090 A * 6/1990 Johansson ..... A47K 17/024 5/662
5,060,327 A 10/1991 Celestina et al.
5,337,430 A * 8/1994 Schlein ..... A47C 21/00 5/662
6,047,424 A 4/2000 Osborne et al.
6,058,531 A * 5/2000 Carroll ..... A47C 21/08 5/428
D436,474 S 1/2001 Morren
D475,559 S 6/2003 Roussy
6,629,325 B2 10/2003 Heavrin
D520,783 S * 5/2006 Freeborn ..... D6/718.3
7,257,850 B1 8/2007 Tekulve
7,467,427 B1 12/2008 Wu et al.
7,472,445 B2 1/2009 Miller
7,568,249 B1 * 8/2009 Kunde ..... A61G 7/053 5/424
7,805,789 B1 * 10/2010 Dean ..... A61G 7/053 5/662
2001/0027578 A1 * 10/2001 Brooke ..... A61G 7/0522 5/662
2003/0056293 A1 * 3/2003 Brooke ..... A61G 7/0524 5/662

(Continued)

*Primary Examiner* — Peter M. Cuomo
*Assistant Examiner* — Ifeolu A Adeboyejo
(74) *Attorney, Agent, or Firm* — The Webb Law Firm

(57) ABSTRACT

A patient assist handle includes an outer frame member, an inner frame member positioned within the outer frame member, a support post connected to the outer frame member, the support post having a first end and an opposing second end, a rotation actuator provided on the first end of the support post, the rotation actuator allowing rotation of the patient assist handle about a first rotation axis, and a release mechanism provided on the second end of the support post, the release mechanism allowing rotation of the patient assist handle about a second rotation axis.

22 Claims, 15 Drawing Sheets

(56) References Cited

U.S. PATENT DOCUMENTS

| | | | | |
|---|---|---|---|---|
| 2003/0093860 | A1* | 5/2003 | Kramer | A61G 7/0514 5/600 |
| 2003/0167568 | A1* | 9/2003 | Brooke | A61G 7/0509 5/430 |
| 2005/0120485 | A1* | 6/2005 | Sebastien | A61G 7/053 5/662 |
| 2005/0144720 | A1 | 7/2005 | Poulin et al. | |
| 2006/0085917 | A1 | 4/2006 | Miller | |
| 2006/0130238 | A1 | 6/2006 | Smith | |
| 2007/0151032 | A1* | 7/2007 | Heavrin | A47C 21/08 5/662 |
| 2009/0229049 | A1 | 9/2009 | Heimbrock et al. | |

* cited by examiner

TWO-PLANE, FOLDING PATIENT ASSIST HANDLE

BACKGROUND OF THE INVENTION

Field of the Invention

The present disclosure relates, generally, to a patient assist handle for aiding a patient from moving to a resting/sitting position to a standing position and vice versa and, in particular, to a two-plane folding patient assist handle for a hospital bed.

Description of Related Art

With a growing shortage of nursing resources and personnel in many long term care markets, encouraging self-mobility for patients, especially elderly patients, is a trending notion in long term care facilities. Many providers offer bed exiting aids in the form of a quarter length side rail and fixed handle loop to cope with this self-mobility demand. These solutions, however, all share a fundamental usability and ergonomic problem when users are egressing from a bed or mattress. In particular, the hand grip placement and mounting location of these mobility aids are not ideally positioned in relation to the user, which leads to the users not being able to exert their maximum strength comfortably to help themselves out of the bed. Since maximum strength cannot be exerted by the user, this leads to greater risks of falls, strains, and increased numbers of nurse calls for the patient. Further, current mobility aids are not designed to provide additional support for wheelchair users during the transfer of the patient from the bed to a wheelchair and vice versa.

Currently, there are two types of mobility aids in the market. A quarter length side rail is a mobility aid designed to provide users with multiple grab points near the head end of a patient bed. The side rail allows the user to maneuver around the patient bed more easily while the patient is lying down, but does not assist in patient egress/ingress from/to the patient bed. Further, if the patient exits the patient bed with the backrest in a flat position, the side rail is too far to reach, forcing the patient to sit higher up on the bed. If the patient raises the backrest to a higher position, the hand grab points of the side rail become too high to reach, especially for patients with a smaller stature. The side rail design also does not provide support for wheelchair users.

Another type of mobility aid is a handle loop that provides the user with a means to sit up and stand from a patient bed. This handle loop, however, does not provide additional leverage and support for wheelchair users. Further, the user cannot reach for the handle loop while lying down on the patient bed to ease maneuvering in the patient bed. Another drawback with the handle loop is that the patient bed frame will not allow a quarter length side rail to be mounted. The caregiver and/or patient must decide which mobility aid is most needed and remove the unwanted mobility aid.

Therefore, there is a current need for a mobility aid that provides an ergonomically designed supporting aid that allows a patient to apply maximum strength themselves to comfortably egress out of the bed. A further need exists for a mobility aid that includes a two-plane folding design, which provides additional leverage and support for both wheelchair and non-wheelchair patients during bed egress and ingress.

SUMMARY OF THE INVENTION

In view of the foregoing, the present disclosure includes a two-plane, folding patient assist handle designed to improve a patient's mobility when egressing and ingressing a bed. In one example of the present disclosure, a patient assist handle includes an outer frame member, an inner frame member positioned within the outer frame member, a support post connected to the outer frame member, the support post having a first end and an opposing second end, a rotation actuator provided on the first end of the support post, the rotation actuator allowing rotation of the patient assist handle about a first rotation axis, and a release mechanism provided on the second end of the support post, the release mechanism allowing rotation of the patient assist handle about a second rotation axis.

In another example of the present disclosure, the first rotation axis may extend substantially perpendicular to the second rotation axis. The first rotation axis may extend in a vertical plane and the second rotation axis may extend in a horizontal plane. The rotation actuator may be positioned within the outer frame member. The rotation actuator may be a depressible button. Upon applying pressure to the depressible button, rotation of the patient assist handle about the second rotation axis may be permitted. The rotation actuator may be positioned outside of the outer frame member. A mounting bracket may be connected to the release mechanism. The mounting bracket may be configured to attach the patient assist handle to a patient bed. The release mechanism may include a spring-biased pull pin, and a positioning plate defining at least one aperture to receive the pull pin. The release mechanism may include a plunger, a plate defining a slot therein, a locking pin releasably engaged with the plunger, and a slot pin movable within the slot defined in the plate. The plunger may be configured to move the locking pin into an unlocked position to permit the slot pin to move within the slot, thereby permitting rotation of the patient assist handle about the second rotation axis. The locking pin may be spring-loaded so that, upon release of pressure on the plunger, the locking pin moves into a locked position to prevent rotation of the patient assist handle about the second rotation axis.

In another example of the present disclosure, a patient bed may include an underframe, and a patient assist handle mounted on the underframe. The patient assist handle may include an outer frame member, an inner frame member positioned within the outer frame member, a support post connected to the outer frame member, the support post having a first end and an opposing second end, a rotation actuator provided on the first end of the support post, the rotation actuator allowing rotation of the patient assist handle about a first rotation axis, and a release mechanism provided on the second end of the support post, the release mechanism allowing rotation of the patient assist handle about a second rotation axis.

In another example of the present disclosure, the first rotation axis may extend substantially perpendicular to the second rotation axis. The first rotation axis may extend in a vertical plane and the second rotation axis extends in a horizontal plane. The rotation actuator may be positioned within the outer frame member. The rotation actuator may be a depressible button. Upon applying pressure to the depressible button, rotation of the patient assist handle about the second rotation axis may be permitted. The rotation actuator may be positioned outside of the outer frame member. A mounting bracket may be connected to the release mechanism. The mounting bracket may be configured to attach the patient assist handle to a patient bed. The release mechanism may include a spring-biased pull pin, and a positioning plate defining at least one aperture to receive the pull pin. The release mechanism may include a plunger, a plate defining a slot therein, a locking pin releasably engaged with the plunger, and a slot pin movable within the slot defined in the plate. The plunger may be configured to move the locking pin into an unlocked position to permit the slot pin to move within the slot, thereby permitting rotation of the patient assist handle about the second rotation axis. The locking pin may be spring-loaded so that, upon release of pressure on the plunger, the locking pin moves into a locked position to prevent rotation of the patient assist handle about the second rotation axis.

Further aspects will now be described in the following numbered clauses.

Clause 1: A patient assist handle, comprising: an outer frame member; an inner frame member positioned within the outer frame member; a support post connected to the outer frame member, the support post having a first end and an opposing second end; a rotation actuator provided on the first end of the support post, the rotation actuator allowing rotation of the patient assist handle about a first rotation axis; and a release mechanism provided on the second end of the support post, the release mechanism allowing rotation of the patient assist handle about a second rotation axis.

Clause 2: The patient assist handle as claimed in Clause 1, wherein the first rotation axis extends substantially perpendicular to the second rotation axis.

Clause 3: The patient assist handle as claimed in either Clause 1 or Clause 2, wherein the first rotation axis extends in a vertical plane and the second rotation axis extends in a horizontal plane.

Clause 4: The patient assist handle as claimed in any of Clauses 1-3, wherein the rotation actuator is positioned within the outer frame member.

Clause 5: The patient assist handle as claimed in any of Clauses 1-4, wherein the rotation actuator is a depressible button, and wherein, upon applying pressure to the depressible button, rotation of the patient assist handle about the second rotation axis is permitted.

Clause 6: The patient assist handle as claimed in any of Clauses 1-5, wherein the rotation actuator is positioned outside of the outer frame member.

Clause 7: The patient assist handle as claimed in any of Clauses 1-6, further comprising a mounting bracket connected to the release mechanism, wherein the mounting bracket is configured to attach the patient assist handle to a patient bed.

Clause 8: The patient assist handle as claimed in any of Clauses 1-7, wherein the release mechanism comprises a spring-biased pull pin; and a positioning plate defining at least one aperture to receive the pull pin.

Clause 9: The patient assist handle as claimed in Clauses 1-8, wherein the release mechanism comprises: a plunger; a plate defining a slot therein; a locking pin releasably engaged with the plunger; and a slot pin movable within the slot defined in the plate, wherein the plunger is configured to move the locking pin into an unlocked position to permit the slot pin to move within the slot, thereby permitting rotation of the patient assist handle about the second rotation axis.

Clause 10: The patient assist handle as claimed in Clause 9, wherein the locking pin is spring-loaded so that, upon release of pressure on the plunger, the locking pin moves into a locked position to prevent rotation of the patient assist handle about the second rotation axis.

Clause 11: A patient bed, comprising: an underframe; and a patient assist handle mounted on the underframe, comprising: an outer frame member; an inner frame member positioned within the outer frame member; a support post connected to the outer frame member, the support post having a first end and an opposing second end; a rotation actuator provided on the first end of the support post, the rotation actuator allowing rotation of the patient assist handle about a first rotation axis; and a release mechanism provided on the second end of the support post, the release mechanism allowing rotation of the patient assist handle about a second rotation axis.

Clause 12: The patient assist handle as claimed in Clause 11, wherein the first rotation axis extends substantially perpendicular to the second rotation axis.

Clause 13: The patient assist handle as claimed in either Clause 11 or Clause 12, wherein the first rotation axis extends in a vertical plane and the second rotation axis extends in a horizontal plane.

Clause 14: The patient assist handle as claimed in any of Clauses 11-13, wherein the rotation actuator is positioned within the outer frame member.

Clause 15: The patient assist handle as claimed in any of Clauses 11-14, wherein the rotation actuator is a depressible button, and wherein, upon applying pressure to the depressible button, rotation of the patient assist handle about the second rotation axis is permitted.

Clause 16: The patient assist handle as claimed in any of Clauses 11-15, wherein the rotation actuator is positioned outside of the outer frame member.

Clause 17: The patient assist handle as claimed in any of Clauses 11-16, further comprising a mounting bracket connected to the release mechanism, wherein the mounting bracket is configured to attach the patient assist handle to a patient bed.

Clause 18: The patient assist handle as claimed in any of Clauses 11-17, wherein the release mechanism comprises a spring-biased pull pin; and a positioning plate defining at least one aperture to receive the pull pin.

Clause 19: The patient assist handle as claimed in any of Clauses 11-18, wherein the release mechanism comprises: a plunger; a plate defining a slot therein; a locking pin releasably engaged with the plunger; and a slot pin movable within the slot defined in the plate, wherein the plunger is configured to move the locking pin into an unlocked position to permit the slot pin to move within the slot, thereby permitting rotation of the patient assist handle about the second rotation axis.

Clause 20: The patient assist handle as claimed in Clause 19, wherein the locking pin is spring-loaded so that, upon release of pressure on the plunger, the locking pin moves into a locked position to prevent rotation of the patient assist handle about the second rotation axis.

These and other features and characteristics of the patient assist handle, as well as the methods of operation and functions of the related elements of the system, will become more apparent upon consideration of the following description and the appended claims with reference to the accompanying drawings, all of which form a part of this specification, wherein like reference numerals designate corresponding parts in the various figures. It is to be expressly understood, however, that the drawings are for the purpose of illustration and description only, and are not intended as a definition of the limits of the disclosure. As used in the specification and claims, the singular form of "a", "an", and "the" include plural referents unless the context clearly dictates otherwise.

DESCRIPTION OF THE INVENTION

Figure 1:
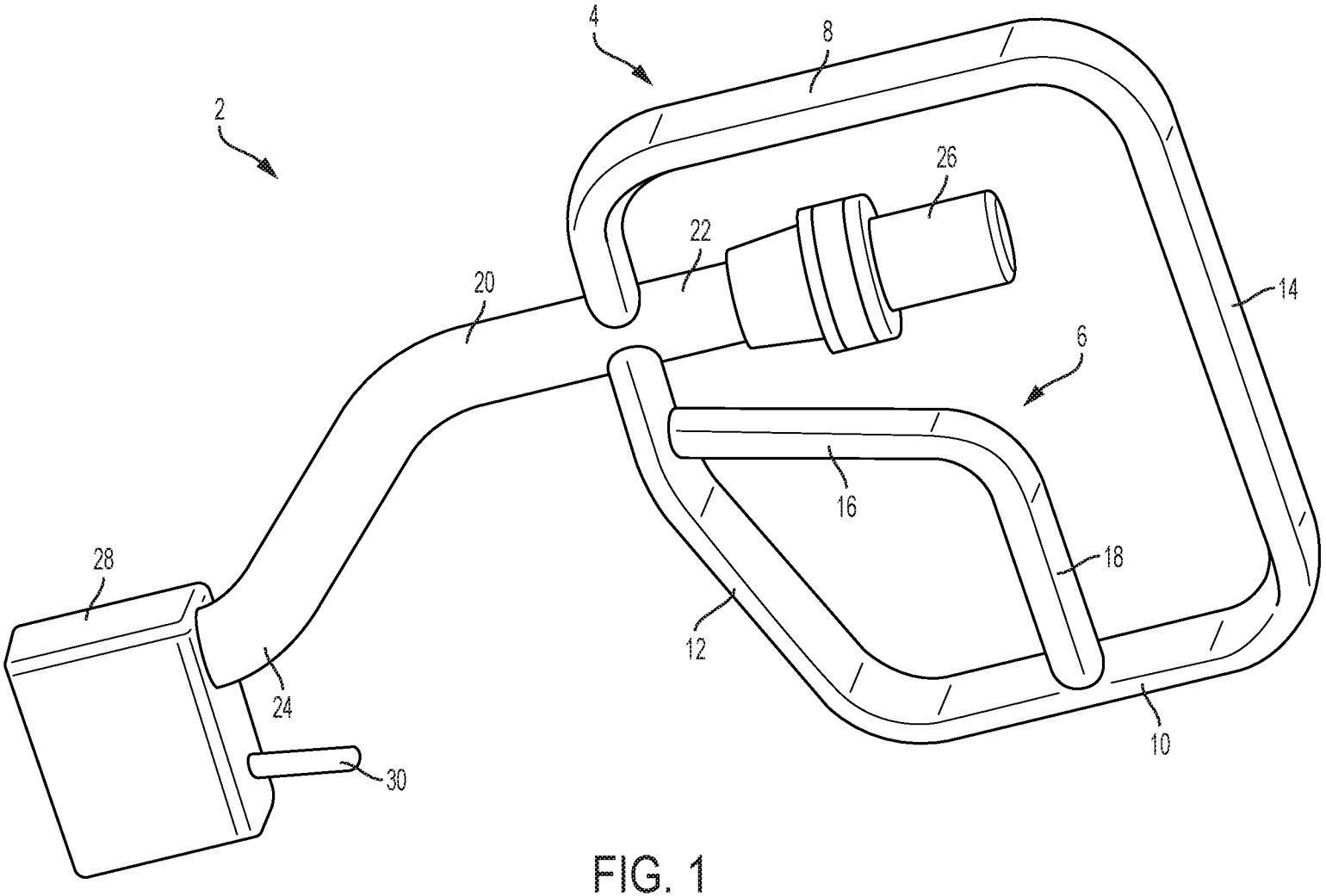
FIG. 1 is a perspective view of a patient assist handle according to one example of the present disclosure.

For purposes of the description hereinafter, the terms "upper", "lower", "right", "left", "vertical", "horizontal", "top", "bottom", "lateral", "longitudinal", and derivatives thereof, shall relate to the invention as it is oriented in the figures. However, it is to be understood that the invention may assume alternative variations and step sequences, except where expressly specified to the contrary. It is also to be understood that the specific systems and processes illustrated in the attached drawings, and described in the following specification, are simply exemplary examples of the invention. Hence, specific dimensions and other physical characteristics related to the examples disclosed herein are not to be considered as limiting.

Referring to the drawings in which like reference numerals refer to like parts throughout the several views thereof, the present disclosure is generally directed to a patient assist handle for a patient bed and, more particularly, to a two-plane, folding patient assist handle for a patient bed to assist a patient egress and ingress from/to the patient bed. The patient assist handle can be used with long term care patient beds, acute care patient beds, and any other beds from which patients need to egress and ingress. The patient assist handle is intended to replace current quarter length side rails that are used in patient beds.

Figure 2:
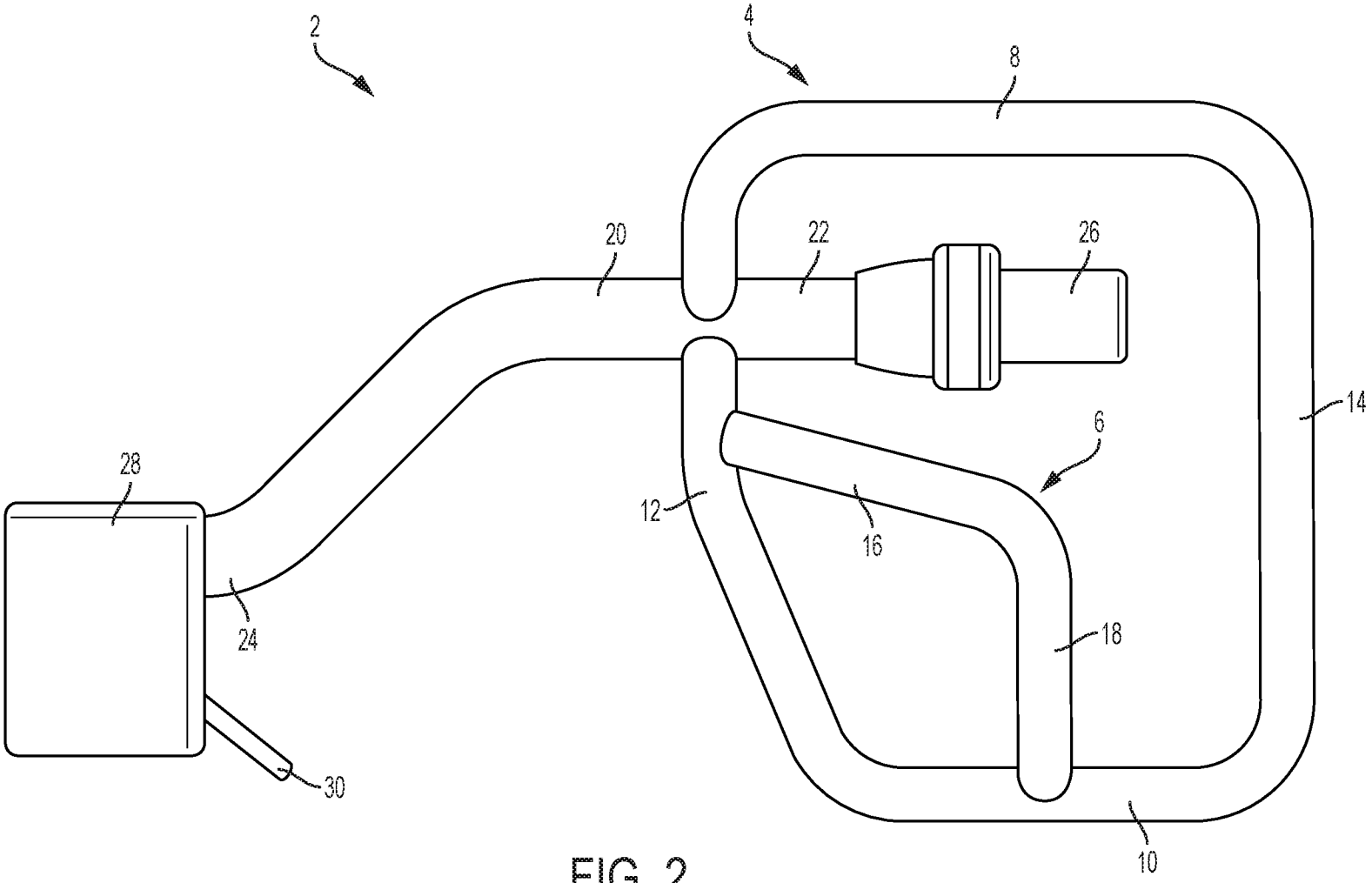
FIG. 2 is a front view of the patient assist handle of FIG. 1.
Figure 3:
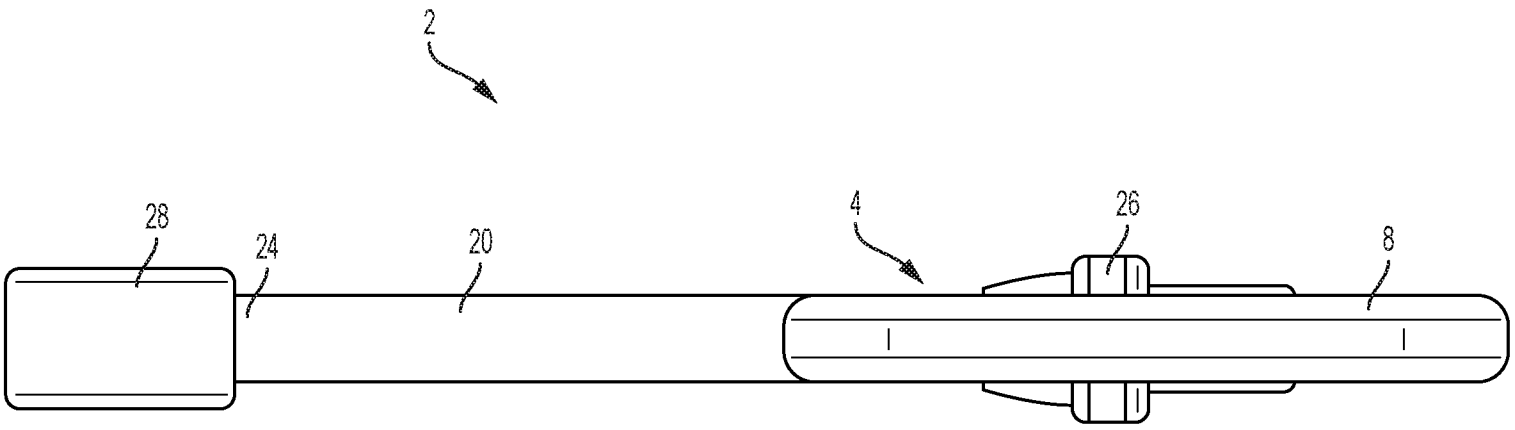
FIG. 3 is a side view of the patient assist handle of FIG. 1.

Referring to FIGS. 1-3, a patient assist handle 2 (hereinafter referred to as "handle 2") according to one example of the present disclosure is described. The handle 2 includes an outer frame member 4 and an inner frame member 6. The outer frame member 4 may be substantially square- or rectangular-shaped with rounded corners. The outer frame member 4 is formed from two opposing side members 8, 10, a bottom member 12, and a top member 14. In one example, the side members 8, 10 extend substantially perpendicular to the bottom member 12 and the top member 14. Each of the side members 8-14 are designed as a plurality of grip locations for a patient to grasp during egress or ingress from a patient bed. The inner frame member 6 may be positioned within the outer frame member 4. In one example, the inner frame member 6 is connected to one of the side members 10 of the outer frame member 4 and the bottom member 12 of the outer frame member 4. In one example, the inner frame member 6 includes a substantially vertical member 16 and a substantially horizontal member 18. The outer frame member 4 and the inner frame member 6 may be formed or molded as a monolithic structure. In another example, the outer frame member 4 and the inner frame member 6 are welded together, adhesively connected, or mechanically fastened together. In one example, the handle 2 is made of plastic or metal. In another example, the handle 2 is made of metal with a soft-touch over-mold surface treatment.

With continued reference to FIGS. 1-3, in one example of the present disclosure, the outer frame member 4 is connected to or formed with a support post 20. The support post 20 may be substantially cylindrical and extends from a first end 22 to an opposing second end 24. A rotation actuator 26 may be provided on the first end 22 of the support post 20. As discussed in greater detail below, the rotation actuator 26 can be actuated by a patient to enable rotation of the handle 2 relative to a patient bed. In one example, the rotation actuator 26 enables rotation of the handle 2 up to 90°. It is also contemplated, however, that alternative or additional rotation limitations may be provided by the rotation actuator 26. In one example, the rotation actuator 26 is a depressible, spring-loaded button that prevents rotation of the handle 2 when not pressed and allows rotation of the handle 2 when pressed down and held by a patient. Since the top member 14 of the outer frame member 4 is positioned above and over the rotation actuator 26, a patient or caregiver cannot unintentionally lean on the rotation actuator 26. A patient or caregiver must purposefully place his/her hand underneath the top member 14 to access the rotation actuator 26. A release mechanism 28 may be provided on the second end 22 of the support post 20. As discussed in greater detail below, the release mechanism 28 can be actuated by a caregiver to enable rotation of the handle 2 between a stowed position and a first extended position. The release mechanism 28 includes a tab 30 that a caregiver can activate to unlock the handle 2 from the first extended position, thereby allowing the handle 2 to be rotated down into the stowed position.

Figure 4:
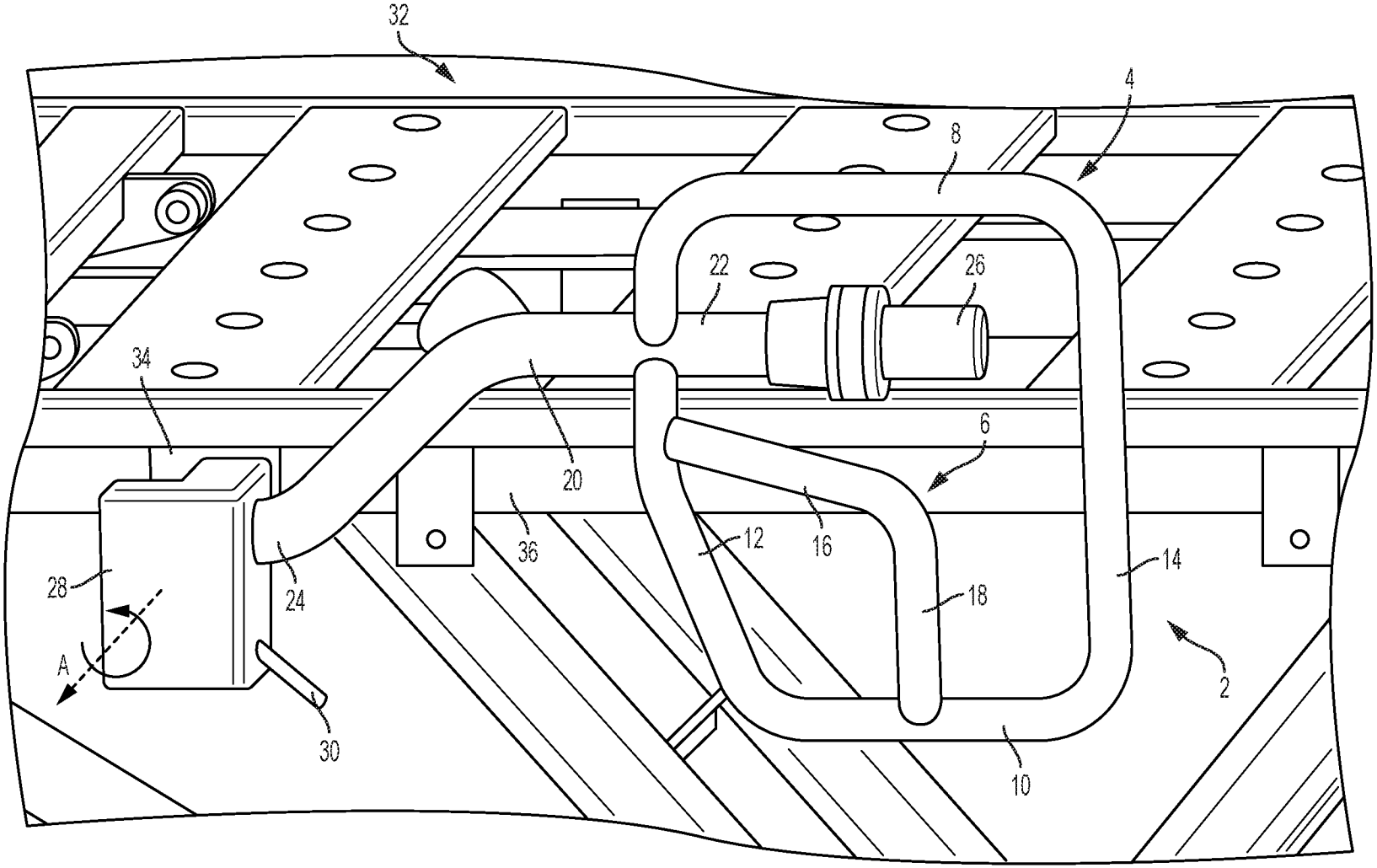
FIG. 4 is a perspective view of the patient assist handle of FIG. 1 connected to a bed with the patient assist handle in a stowed position.
Figure 5:
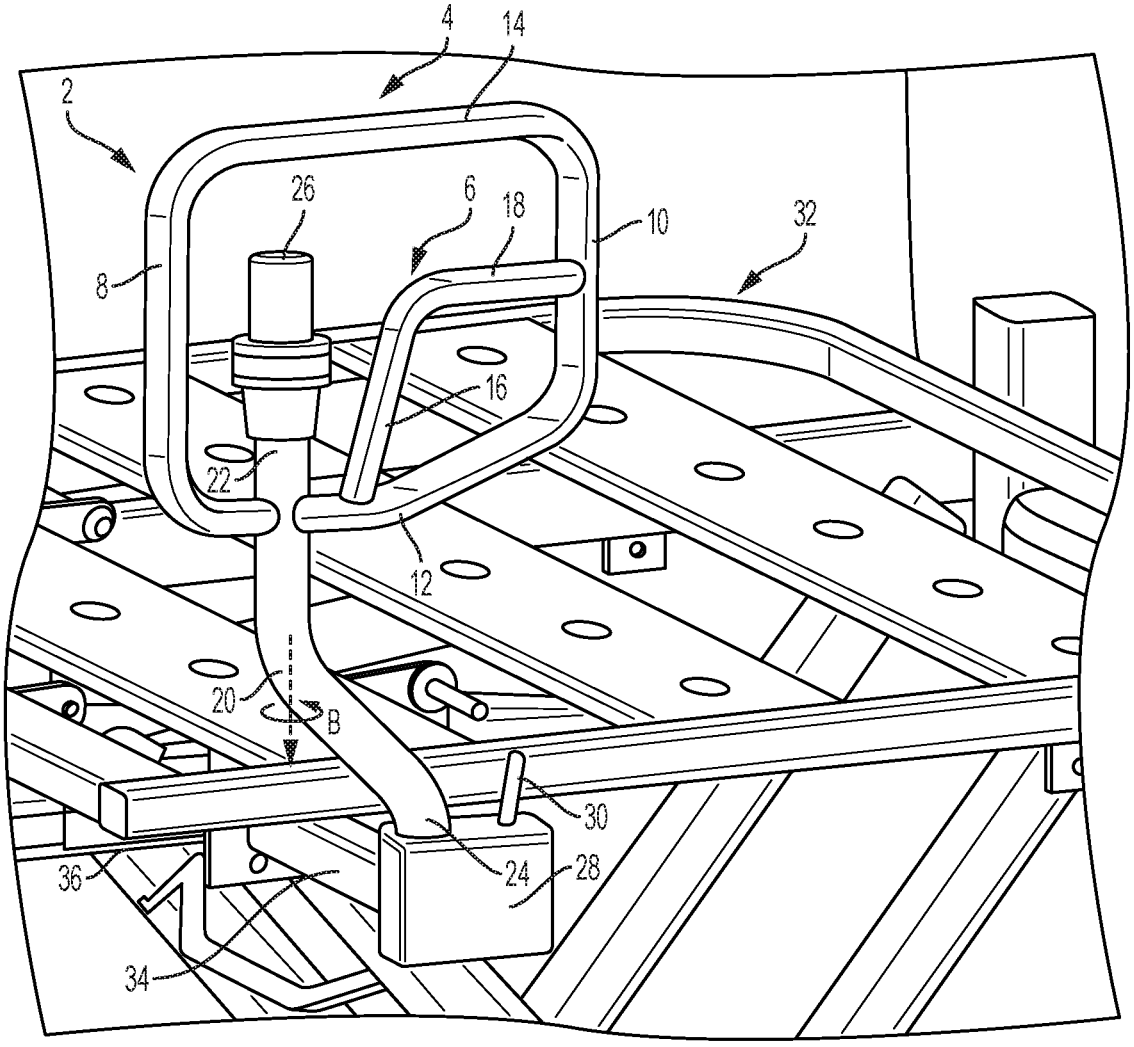
FIG. 5 is a perspective view of the patient assist handle of FIG. 1 connected to a bed with the patient assist handle in a first extended position.
Figure 6:
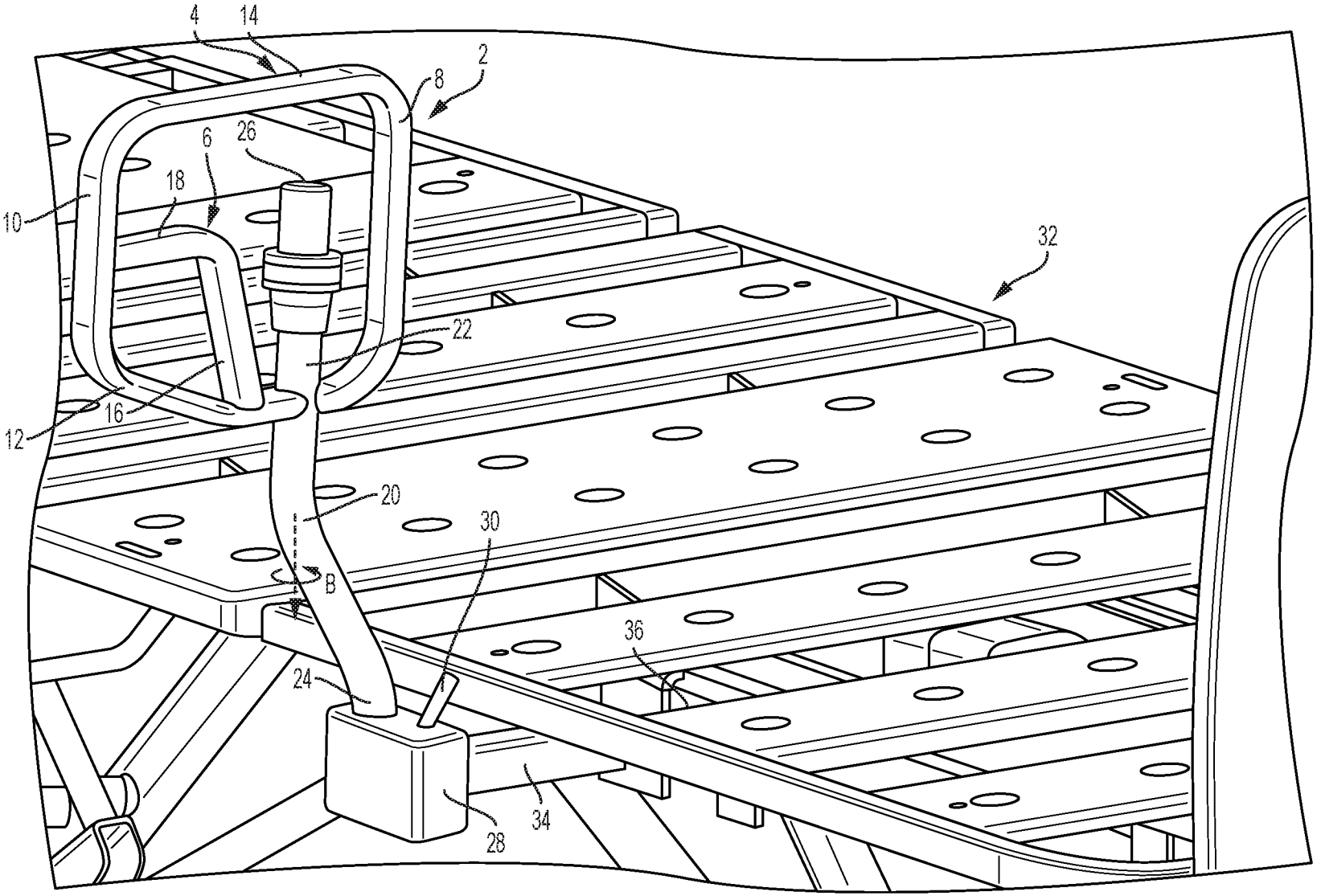
FIG. 6 is a perspective view of the patient assist handle of FIG. 1 connected to a bed with the patient assist handle in a second extended position.

With reference to FIGS. 4-6, operation and use of the handle 2 is described in detail. While FIGS. 4-6 depict the use of one handle 2 on the patient bed 32, it is also contemplated that two handles 2 could be provided on the same side of the patient bed 32 so that a handle 2 is provided on either side of the patient as he/she moves on/from the patient bed 32. As briefly described above, the handle 2 incorporates a two-movement, two-plane orientation system to assist mobility-challenged patients in getting into and out of a patient bed. As shown in FIGS. 4 and 5, the handle 2 may be attached to the patient bed 32 using a bracket 34 that is mechanically fastened to an underframe 36 of the patient bed 32. In this arrangement, the bracket 34 is not movable relative to the patient bed 32 such that the handle 2 cannot slide along the length of the patient bed 32. It is also contemplated that the bracket 34 could slide along the length of the patient bed 32 to accommodate different size patient beds and/or patients. In yet another example, the handle 2 may be removable from the bracket 34 so that the handle 2 can be moved to a bracket 34 provided on the opposite side of the patient bed 32. When connected to the patient bed 32, the handle 2 is positioned laterally spaced from a longitudinal side of the patient bed 32. FIG. 4 depicts the handle 2 in a stowed position relative to the patient bed 32. In the stowed position, a longitudinal axis of the support post 20 extends parallel to a longitudinal axis of the patient bed 32. In the stowed position, at least a portion of the outer frame 4 extends above the top surface of the patient bed 32 to act as a side rail for a patient lying in the bed. While held in the stowed position, the handle 2 is freely movable relative to the patient bed 32 so that the handle 2 is capable of rotation about a rotation axis A that extends substantially perpendicular to the longitudinal axis of the patient bed 32. In one example, the rotation axis A extends in a horizontal plane. In the stowed position, the release mechanism 28 does not lock the handle 2 or prevent rotation of the handle 2. However, it is contemplated that the release mechanism 28 could lock the handle 2 in the stowed position to prevent rotation of the handle 2. In this example, rotation of the handle 2 would only be permitted after the release mechanism 28 has been activated to unlock the handle 2. To move the handle 2 from the stowed position (FIG. 4) to a first extended position (FIG. 5), a patient or caregiver grasps a portion of the outer frame member 4 and pulls the handle 2 upwardly, causing rotation of the handle 2 about the rotation axis A. As the handle 2 is rotated into the first extended position, the handle 2 is locked in place by the release mechanism 28. In other words, the handle 2 is moved from a horizontal position to a vertical position when moved from the stowed position to the first extended position. To move the handle 2 back to the stowed position, a caregiver must actuate the release mechanism 28 to permit rotation of the handle 2 relative to the patient bed 32. When positioned in the first extended position, only a caregiver can access the release mechanism 28 to unlock the handle 2 so that a patient laying in the patient bed 32 does not inadvertently actuate the release mechanism 28 causing the handle 2 to rotate into the stowed position.

As shown in FIG. 5, when the handle 2 is held in the first extended position, the longitudinal axis of the support post 20 extends perpendicularly relative to the longitudinal axis of the patient bed 32. Further, in the first extended position, a longitudinal axis of the outer frame member 4 extends parallel with the longitudinal axis of the patient bed 32. When in the first extended position, the handle 2 provides a plurality of gripping locations for a patient to grasp when maneuvering in the patient bed 32. For example, the patient can grasp one of the side members 8, 10 of the outer frame member 4 or the vertical member 16 of the inner frame member 6 to pull themselves from a lying position into a sitting position. Further, the patient can grasp the top member 14 of the outer frame member 4 to move themselves along the longitudinal axis of the patient bed 32.

With reference to FIG. 6, the handle 2 is shown in a second extended position. In this position, the handle 2 has been rotated approximately 90° about a rotation axis B. In one example, the rotation axis B extends in a vertical plane. In another example, the rotation axis B extends substantially perpendicular to the rotation axis A. By depressing the rotation actuator 26, the patient or caregiver allows the handle 2 to be rotated about the rotation axis B. The patient or caregiver presses the rotation actuator 26 while pulling the handle 2 to swing the handle 2 outwards away from the patient bed 32 and into the second extended position. In the second extended position, the longitudinal axis of the outer frame member 4 extends substantially perpendicular to the longitudinal axis of the patient bed 32. Therefore, after the patient has maneuvered to the edge of the patient bed 32 using the handle 2 in the first extended position, the patient or caregiver can rotate and swing the handle 2 outwardly to the second extended position. In the second extended position, the handle 2 extends away from the patient bed 32 to provide additional leverage and support to the patient as he/she moves from a sitting position on the patient bed 32 to a standing position. Further, the extended handle position provides an extended support structure that a patient in a wheelchair can grasp as he/she moves from the wheelchair to the patient bed 32. Since the handle 2 extends away from the patient bed 32, the wheelchair can be positioned alongside the patient bed 32, while the handle 2 extends to the patient in the wheelchair to grasp and pull themselves out of the wheelchair. To return the handle 2 to the first extended position, the rotation actuator 26 is again depressed by the patient or the caregiver to permit the handle 2 to rotate about the rotation axis B.

The patient assist handle 2 described above provides many advantages to a patient and caregiver. The handle 2 has multiple uses, including as a wheelchair "bridge" support and as a quarter length side rail for the patient when laying in the patient bed 32. Many of the current mobility aids only provide one of these uses. The handle 2 also provides several ergonomic advantages. As described above, the handle 2 is strategically mounted to the patient bed 32, is purposefully designed and sized for the intended type of patient, and the second extended position of the handle 2 mimics a conventional arm rest during bed egress and ingress. Further, with the handle 2 provided in the second extended position, the patient can keep his or her hands as leverage in front of or directly above his or her hips and feet. The handle 2 also allows for greater stability and maneuvering while the patient is standing or walking around the patient bed 32.

When provided in the stowed position, the handle 2 provides an unobstructed access to the patient during patient transfer from or to the patient bed 32. Further, the handle 2 permits easier access to a mattress on the patient bed 32 for changing linens and bedding. The handle 2 also allows for easier access to a bed deck of the patient bed 32 for cleaning. In addition, the stowed position provides a more open and inviting atmosphere to the patient's family members and healthcare professionals. When provided in the first extended position, the assist handle provides convenient grab points for a patient lying down on the patient bed 32 near the patient's shoulder, thereby allowing the patient to reach for additional support and a bio-mechanical advantage to maneuver on the patient bed 32 in a more dignified manner, such as rolling over, switching sleeping positions, accessing a patient's back from a caregiver's perspective, etc. The handle 2 in the first extended position also allows the patient to grasp onto the handle 2 for support and a bio-mechanical advantage when moving to a seated position from a laying-down position. The handle 2 also gives the patient stability support and a bio-mechanical advantage when egressing from the seated position to a standing position. When provided in the second extended position, the handle 2 provides stability support and a bio-mechanical advantage to the patient when egressing from the seated position to the standing position. Further, similar to an office armchair or disability toilet support in public restrooms, the handle 2 gives a patient the confidence, comfort, and additional reach when transferring from a seating position to a walking aid, or vice versa, such as to or from a wheelchair, walking frame, floor lift, or other similar device. The multiple rung design of the handle 2 also provides multiple grab point locations to allow a fallen patient to climb back up, if immediate help is not available.

Alternative examples of the handle 2 are also considered. For example, the handle 2 could rotate to tuck underneath the underframe 36 of the patient bed 32 when not in use. Further, the rotation actuator 26 could be a push-down knob that is used by pushing down a large button or by grabbing around the knob and pulling the knob downwardly. The handle 2 could also be designed to mount and dismount from the patient bed 32 without the use of tools.

Figure 7:
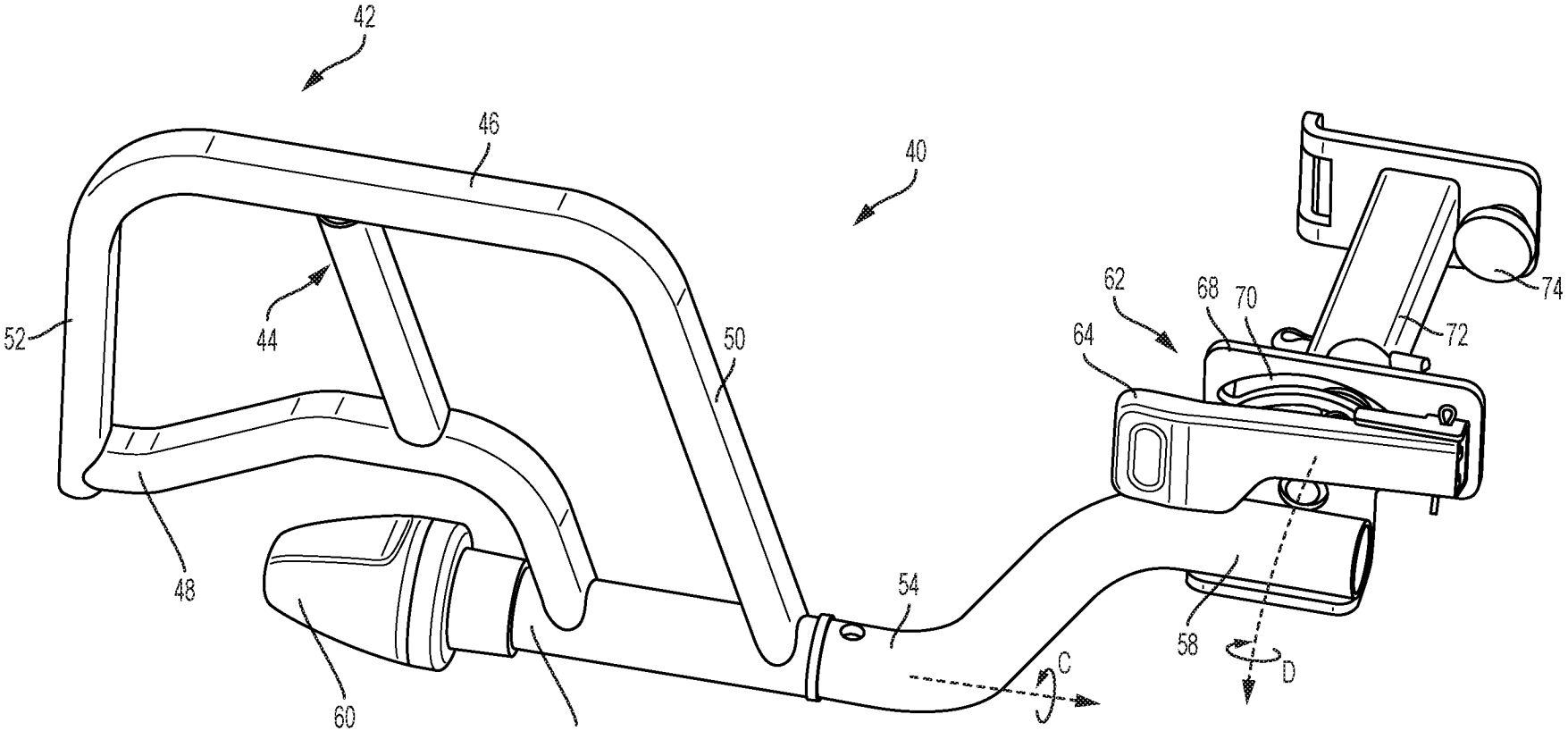
FIG. 7 is a perspective view of a patient assist handle according to another example of the present disclosure.
Figure 8:
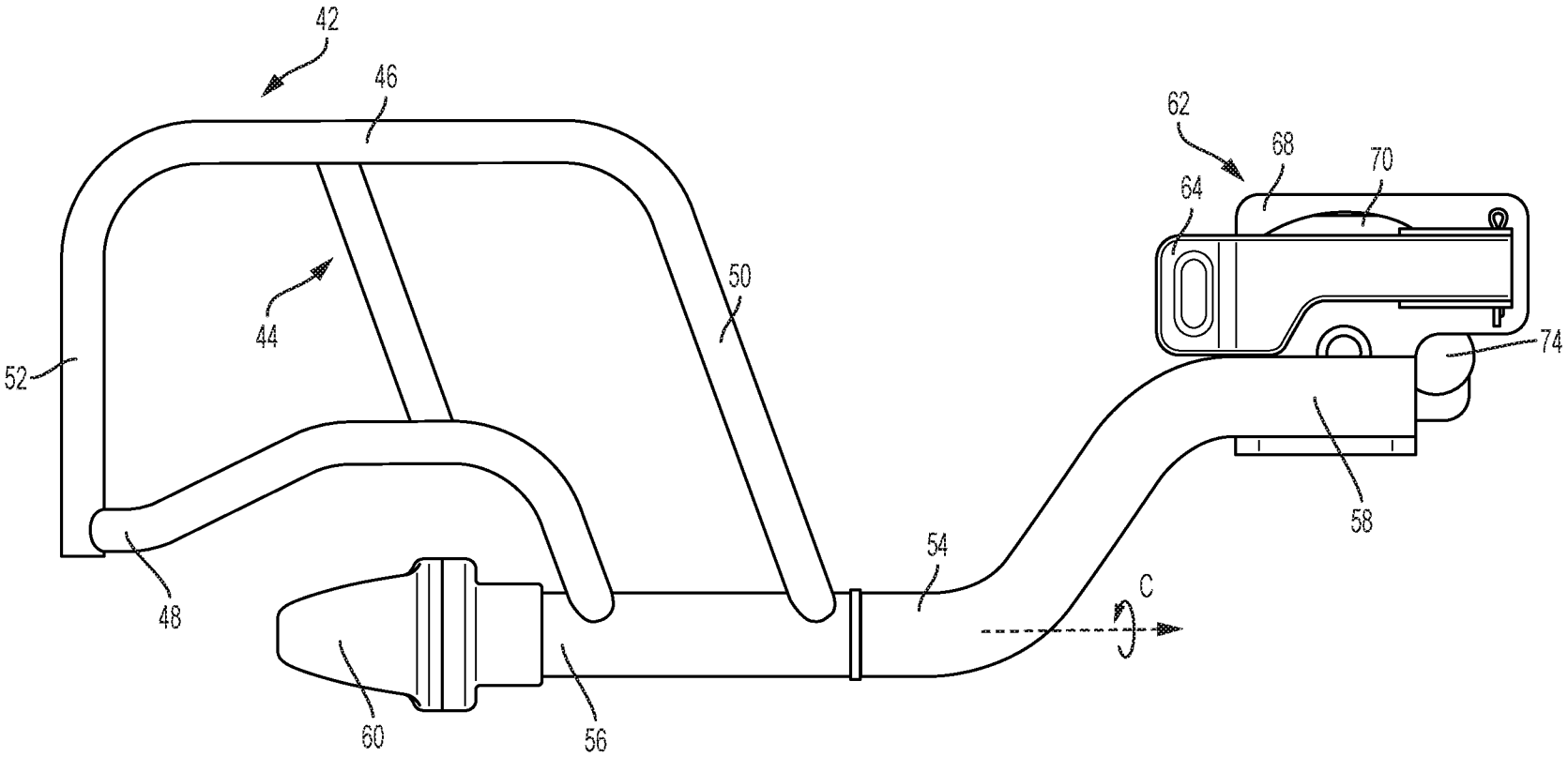
FIG. 8 is a front view of the patient assist handle of FIG. 7.
Figure 9:
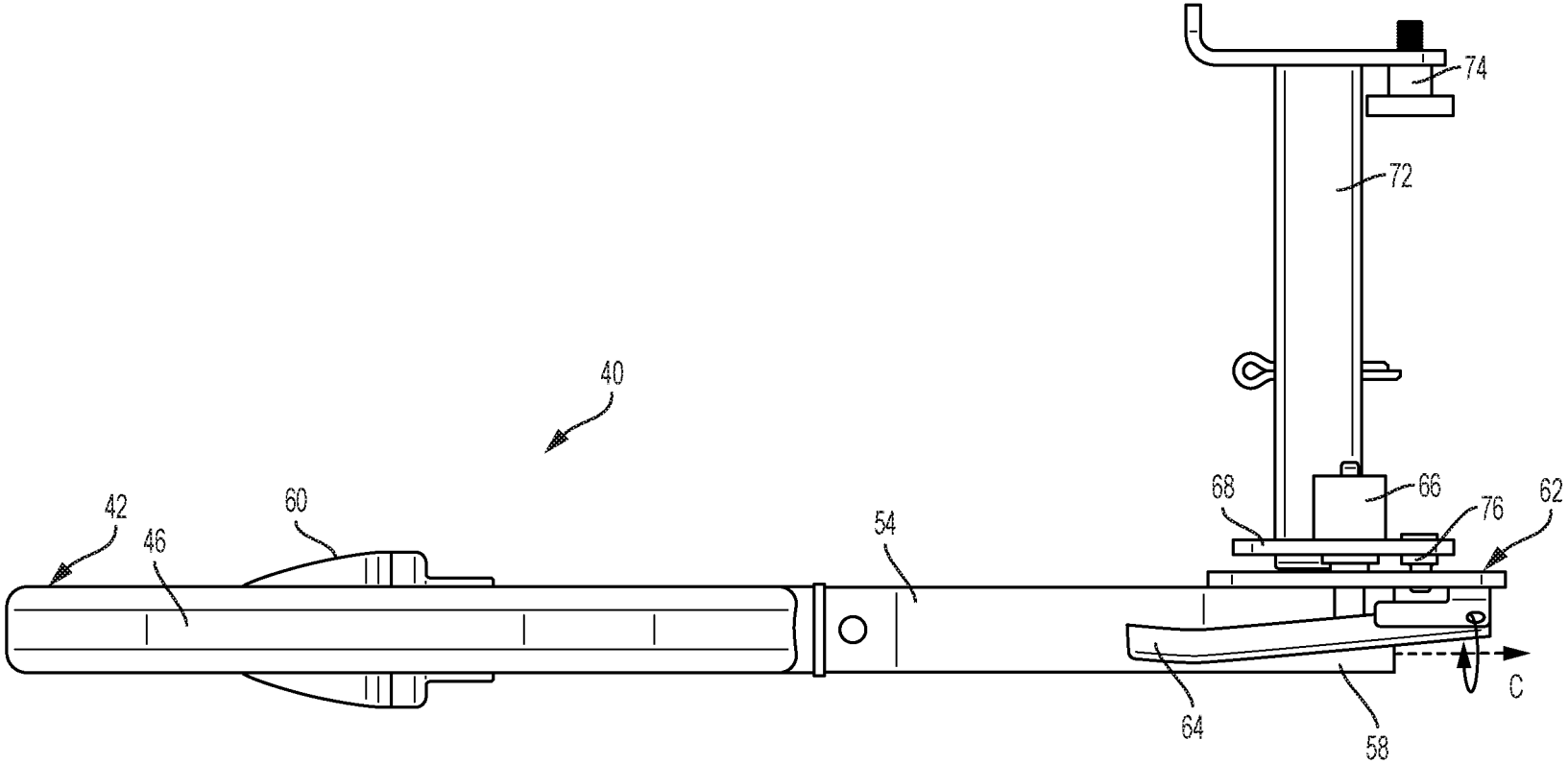
FIG. 9 is a side view of the patient assist handle of FIG. 7.
Figure 10:
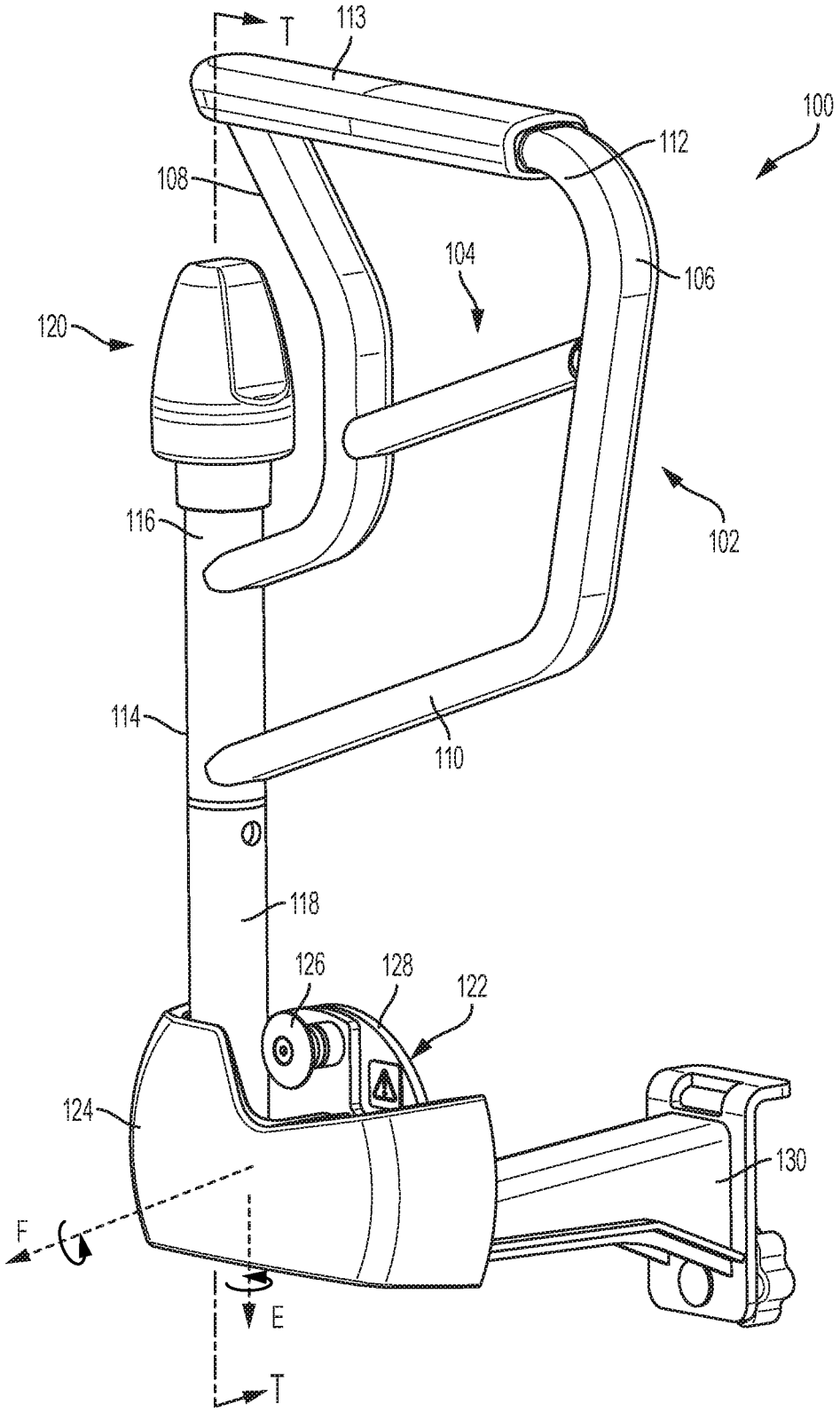
FIG. 10 is a front perspective view of a patient assist handle according to another example of the present disclosure.
Figure 11:
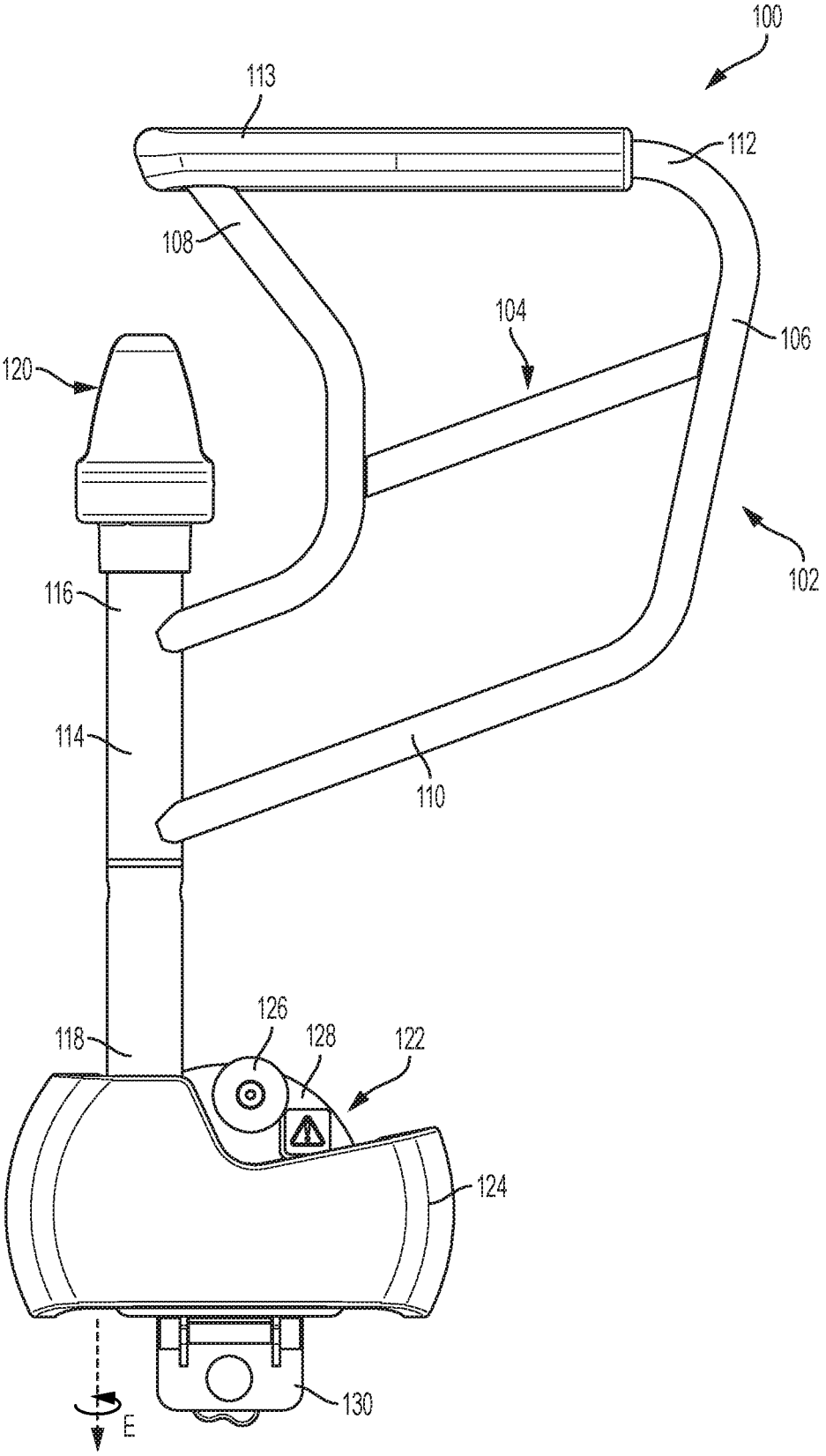
FIG. 11 is a front view of the patient assist handle of FIG. 10.

With reference to FIGS. 7-9, another example of a patient assist handle 40 (hereinafter referred to as "handle" 40) is described. This example of the handle 40 includes many of the same features of the handle 2 described above, with several different design features, as discussed below. The handle 40 includes an outer frame member 42 and an inner frame member 44. The outer frame member 42 includes two side members 46, 48, a bottom member 50, and a top member 52. In this example, the inner frame member 42 merely includes a substantially horizontal member. The two side members 46, 48 may extend substantially perpendicular to the bottom member 50 and the top member 52. The outer frame member 42 is connected to or formed with a support post 54 having a first end 56 and a second end 58. As discussed above, a rotation actuator 60 is provided on the first end 56 of the support post 54 and permits rotation of the handle 40 about a rotation axis C. In this example of the handle 40, the rotation actuator 60 is not positioned within the outer frame member 42, but instead, is positioned outside the outer frame member 42 but underneath the top member 52 of the outer frame member 42 to prevent inadvertent activation of the rotation actuator 60. Activation of the rotation actuator 60 permits rotation of the handle 40 between a first extended position and a second extended position, as described above in connection with the handle 2.

With reference to FIGS. 7 and 9, a release mechanism 62 is provided on the second end 58 of the support post 54. This release mechanism 62 is different from the release mechanism 28 provided with the handle 2 described above. The release mechanism 62 includes a paddle 64, a spring-loaded locking pin 66, and a plate 68 defining a slot 70. The plate 68 is connected to or formed on a mounting bracket 72. The mounting bracket 72 includes a threaded member 74 that is threadedly engaged with a portion of an underframe of a patient bed (not shown) to mount the handle 40 on the patient bed. A slot pin 76 is also provided on the mounting bracket 72 and is configured to extend into the slot 70 defined by the plate 68. The locking pin 66 is mounted on the mounting bracket 72, while the paddle 64 is mounted on the plate 68. The locking pin 66 extends through an opening defined in the plate 68. The second end 58 of the support post 54 is also mounted on the plate 68. The release mechanism 62 is provided to move the handle 40 between a stowed position and the first extended position.

Operation of the release mechanism 62 is described in reference to FIGS. 7 and 9. As shown in FIG. 7, when the handle 40 is in the stowed position, the locking pin 66 is held in the opening of the plate 68 and prevents rotation of the handle 40 relative to the mounting bracket 72. To move the handle 40 from the stowed position to the first extended position, a patient or caregiver will depress the plunger 64 towards the mounting bracket 72, thereby pushing the locking pin 66 out of the opening in the plate 68 towards the mounting bracket 72. By pushing the locking pin 66 out of the opening, the plate 68 is permitted to rotate relative to the mounting bracket 72. Therefore, the patient or caregiver will keep the paddle 64 depressed as the handle 40 is rotated from the stowed position to the first extended position about a rotation axis D. As the handle 40 rotates about the rotation axis D, the slot pin 76 slides along the slot 70 defined in the plate 68 until the handle 40 reaches the first extended position. After the handle 40 has been rotated to the first extended position, the patient or caregiver will release pressure on the paddle 64, thereby allowing the locking pin 66 to spring back into the opening in the plate 68 to lock the handle 40 in the first extended position. With this release mechanism 62, it is also possible to position the handle 40 at angular positions between the stowed position and the first extended position, if desired. For example, pressure on the paddle 64 can be released when the handle 4 is stationed halfway between the stowed position and the first extended position. With release of the pressure on the paddle 64, the locking pin 66 would spring back into the opening on the plate 68 to lock the handle 40 in that half-extended position.

After the handle 40 has been positioned in the desired vertical position using the release mechanism 62, a button of the rotation actuator 60 may be depressed to permit rotation of the handle 40 about the rotation axis C. Once the handle 40 has been positioned in the desired rotational position relative to the patient's bed, the button can be released to re-engage the rotation actuator 60 to prevent further rotation of the handle 40.

With reference to FIGS. 10-15, another example of a patient assist handle 100 (hereinafter referred to as "handle" 100) is described. This example of the handle 100 includes many of the same features of the handles 2, 40 described above, with several different design features, as discussed below. The handle 100 includes an outer frame member 102 and an inner frame member 104. The outer frame member 102 includes two side members 106, 108, a bottom member 110, and a top member 112. The top member 112 may have a gripping portion 113 provided thereon to assist a patient or physician in grasping the handle 100. In this example, the inner frame member 102 merely includes a substantially horizontal member. The two side members 106, 108 may extend substantially perpendicular to the bottom member 110 and the top member 112. The outer frame member 102 is connected to or formed with a support post 114 having a first end 116 and a second end 118. In this example of the handle 100, the support post 114 may be substantially straight without curves or bends as compared to the support post 54 of the handle 40. A rotation actuator 120 is provided on the first end 116 of the support post 114 and permits rotation of the handle 100 about a rotation axis E. In this example of the handle 100, the rotation actuator 120 is not positioned within the outer frame member 102, but instead, is positioned outside the outer frame member 102 but underneath the top member 112 of the outer frame member 102 to prevent inadvertent activation of the rotation actuator 120. Activation of the rotation actuator 120 permits rotation of the handle 100 between a first extended position and a second extended position, as described above in connection with handles 2, 40.

With reference to FIGS. 10-13 and 15, a release mechanism 122 is provided on the second end 118 of the support post 114. This release mechanism 122 is different from the release mechanism 28 provided with the handle 2 described above. The release mechanism 122 includes a housing 124 that surrounds the second end 118 of the support post 114, a spring-loaded pull pin 126, and a positioning plate 128 that receives an end of the pull pin 126. A bracket arrangement 130 is attached to the positioning plate 128 to allow the handle 100 to be removably attached to a bed or other similar structure (not shown). The second end 118 of the support post 114 is received within the housing 124 of the release mechanism 122 and connected to a plate 127 (shown in FIG. 13) that holds the pull pin 126. The plate 127 is rotatable relative to the positioning plate 128 about a rotation shaft 129 (shown in FIG. 15) that is provided on the positioning plate 128.

Figure 12:
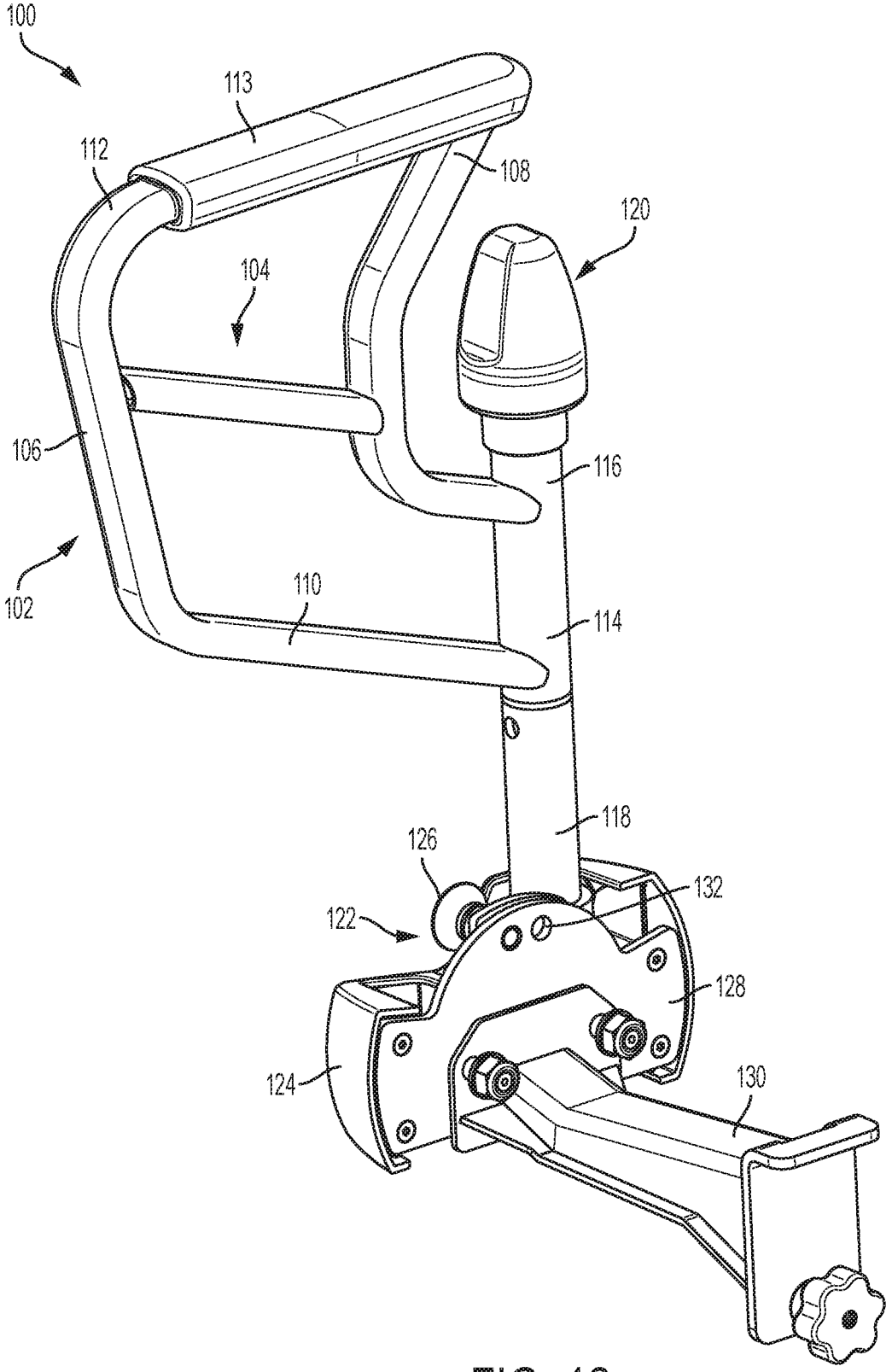
FIG. 12 is a rear perspective view of the patient assist handle of FIG. 10.
Figure 15:
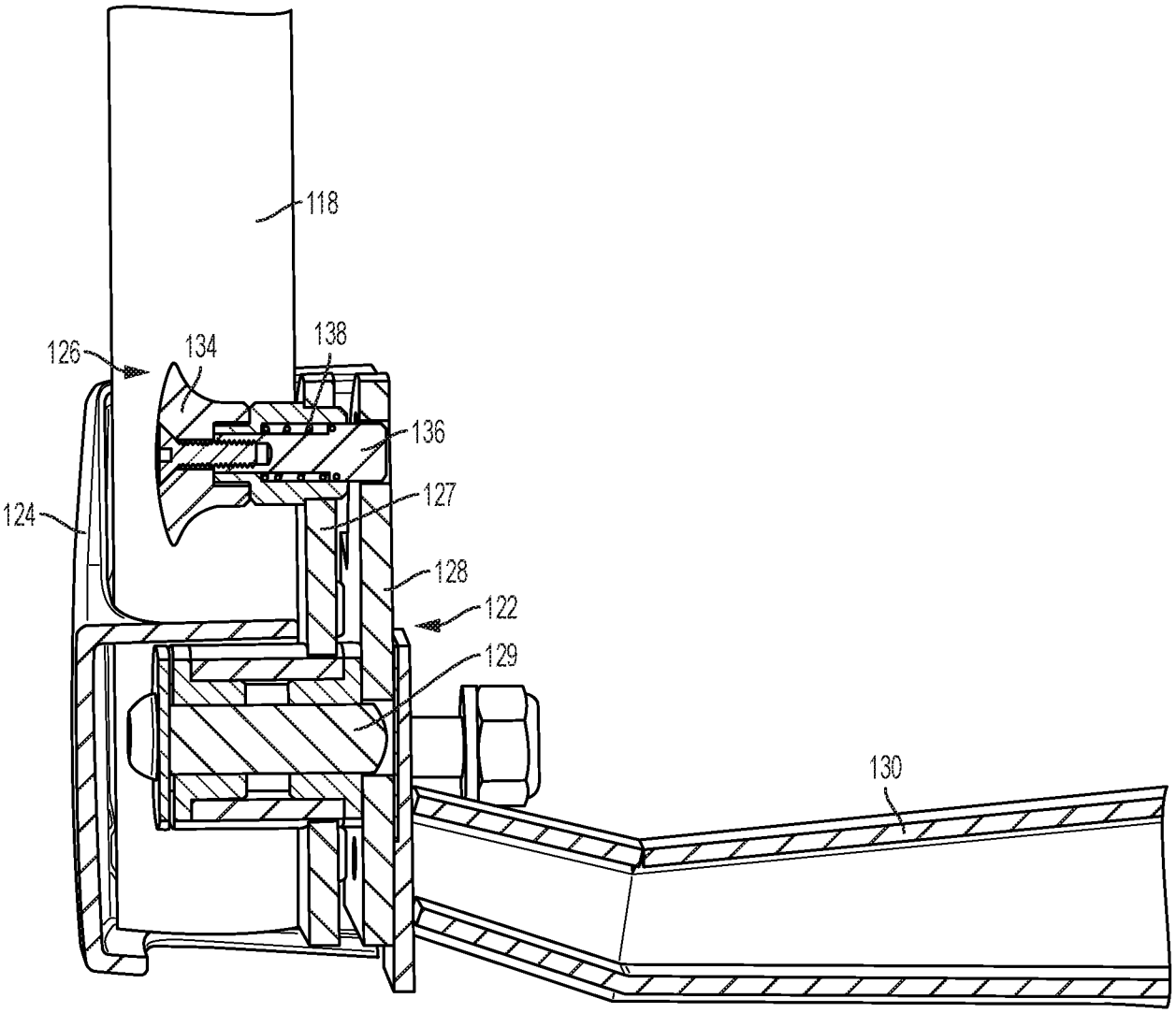
FIG. 15 is a cross-sectional view of a release mechanism of the patient assist handle of FIG. 10 along line T-T.

As shown in FIG. 12, the positioning plate 128 may be mechanically fastened to the housing 124 or, alternatively, may be formed integrally with the housing 124. The positioning plate 128 may define at least two different apertures 132 that are configured to receive the pull pin 126. While the present example shows two different apertures 132, it is also contemplated that the positioning plate 128 may define more or less than two apertures. With reference to FIG. 15, the pull pin 126 includes a handle 134, a pin 136, and a spring 138. To operate the pull pin 126, a physician will pull the handle 134 away from the positioning plate 128 to pull the pin 136, which is operatively connected to the handle 134, away from the positioning plate 128. As the handle 134 is pulled farther away, the pin 136 compresses the spring 138. Therefore, after the physician releases the handle 134, the spring 138 expands to its original position to push the pin 136 towards the positioning plate 128. By using the pull pin 126, the physician can rotate the handle 100 relative to the release mechanism 122.

Figure 13:
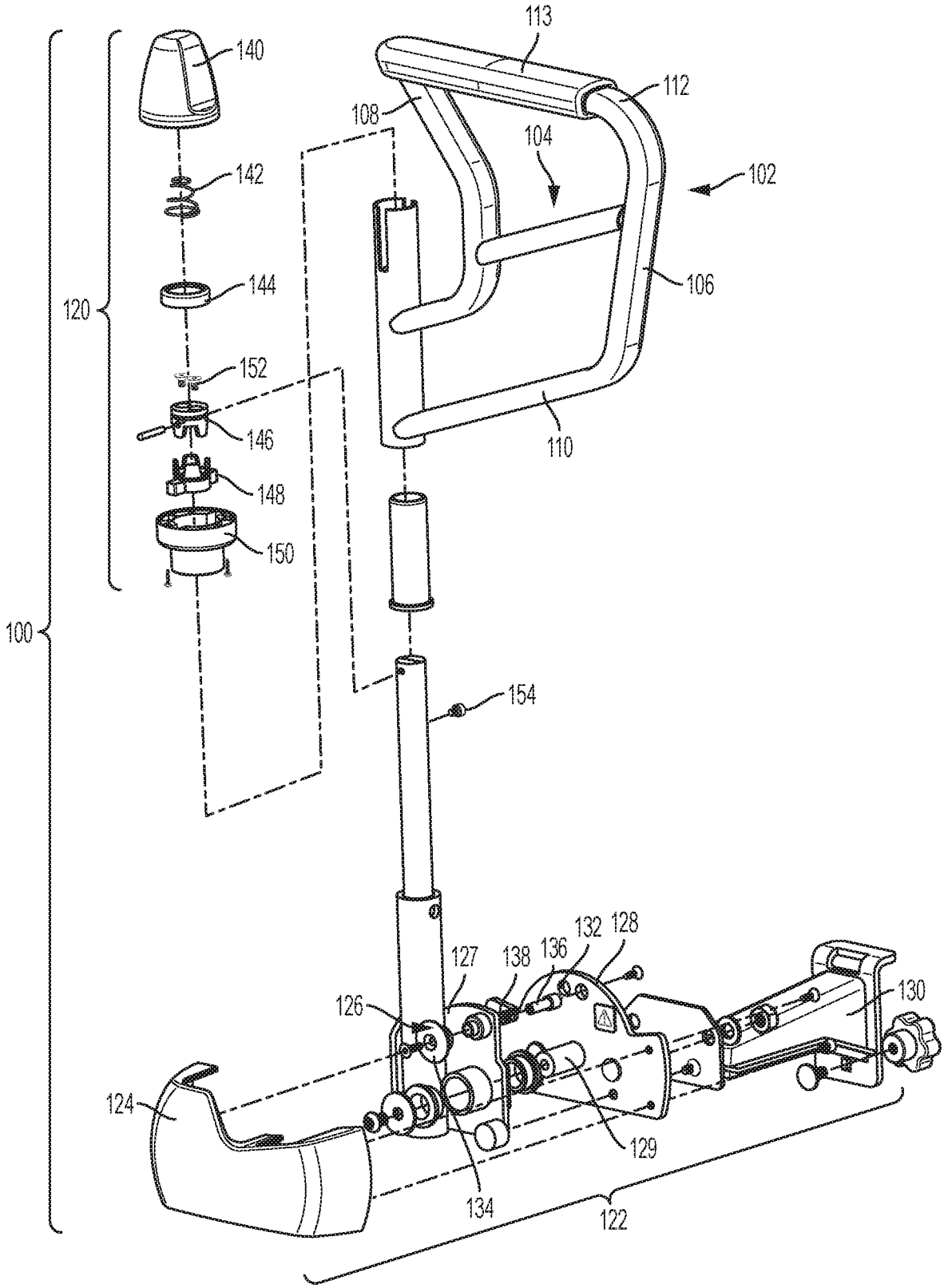
FIG. 13 is an exploded perspective view of the patient assist handle of FIG. 10.
Figure 14:
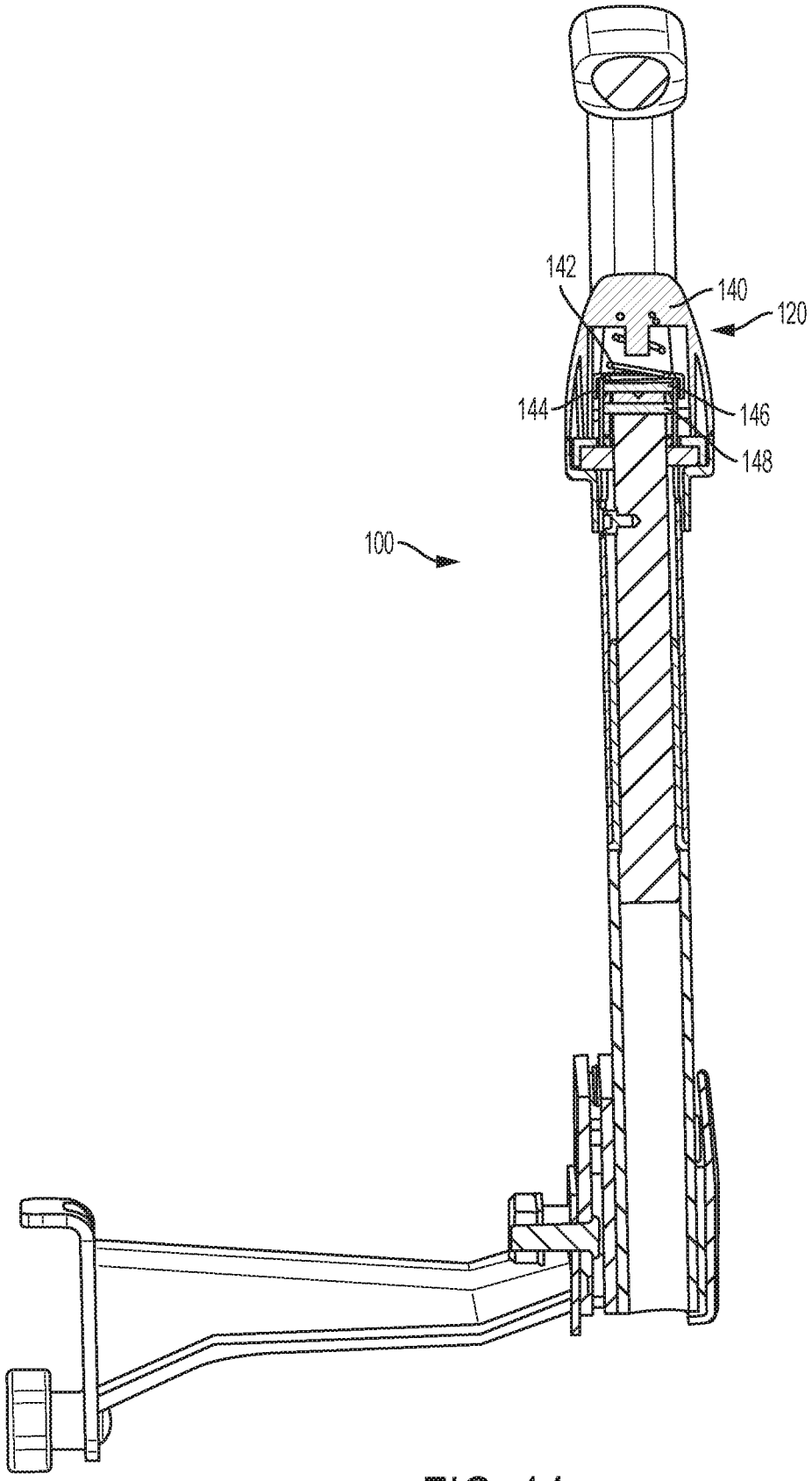
FIG. 14 is a cross-sectional view of the patient assist handle of FIG. 10 along line T-T.

With reference to FIGS. 13 and 14, a more detailed description of the rotation actuator 120 is provided. Although the following description is provided in relation to the rotation actuator 120 of the handle 100, it is to be understood that a similar rotation actuator can be used as the rotation actuators 26 and 60. The rotation actuator 120 may include a button 140, a spring 142 received within the button 140, a cap 144, an upper locking jaw 146, a lower locking jaw 148, and a retainer 150. Each locking jaw 146, 148 may include a plurality of teeth that extend around the circumference of the locking jaw 146, 148. In assembly, the lower lowing jaw 148 and the retainer 150 are received within the first end 116 of the support post 114. An upper portion of the retainer 150 may be received within the button 140. The upper locking jaw 146 may be mechanically fixed to the first end 116 of the support post 114 using screws 152. Therefore, in this assembly, the upper locking jaw 146 is rotationally fixed relative to the support post 114. The lower locking jaw 148 is configured to rotate freely about the support post 114 upon disengagement from the upper locking jaw 146. The cap 144 and the spring 142 are positioned on top of the upper locking jaw 146 within the button 140.

The spring 142 is configured to bias the button 140 towards an extended position. In the event the button 140 is depressed by a patient or physician, the spring 142 is compressed. The spring 142 rests on the lower locking jaw 148. The locking jaws 146, 148 are configured to move between two different positions. In the first position, in which the handle 100 is prevented from rotating about the rotation axis E, the teeth of the locking jaws 146, 148 are engaged with one another so that the locking jaws 146, 148 are unable to rotate relative to one another. In the second position, in which the handle 100 is permitted to rotate about the rotation axis E, the teeth of the locking jaws 146, 148 are disengaged from one another to permit the locking jaws 146, 148 to rotate relative to one another. As the button 140 is depressed, the spring 142 presses against the lower locking jaw 148 to move the lower locking jaw 148 away from the upper locking jaw 146. As the lower locking jaw 148 is moved away from the upper locking jaw 146, the teeth of the locking jaws 146, 148 disengage from one another, thereby permitting the upper locking jaw 146 and, thereby, the handle 100, to rotate. Once pressure on the button 140 is released, the spring 142 moves the lower locking jaw 148 upwardly to engage with the upper locking jaw 146 once again to lock the rotation of the handle 100. In one example, when the locking jaws 146, 148 are disengaged from one another, the handle 100 is permitted to any number of positions in a 360° perimeter. In another example, when the locking jaws 146, 148 are disengaged from one another, the handle 100 is permitted to only move within a 90° radius. In this example, a slot (not shown) defined in the handle 100 may receive a locating pin 154 that extends through the handle 100 and connected to the retainer 150. Therefore, as the handle 100 is rotated about rotation axis E, the locating pin 154 moves within the slot, which acts as a stop at both ends thereof to prevent rotation of more than 90°. It is also contemplated that, in place of the button 140, a pull-up latch (not shown) may be used to engage and disengage the locking jaws 146, 148.

In a first stowed position, in which the handle 100 is rotated to the side of the bed when not in use, a longitudinal axis of the handle 100 may extend parallel with a longitudinal axis of the housing 124 of the release mechanism 122. During operation of the handle 100 and the release mechanism 122, the physician may grasp the handle 100 and pull upwardly on the handle 100 to rotate the handle 100 into a first position about a rotation axis F. As the handle 100 is pulled upwardly, the plate 127 is rotated about the rotation shaft 129 and rotation axis F. Eventually, the handle 100 is pulled into the first position, such that the pull pin 126 snaps into a first aperture 132 defined in the positioning plate 128. Once the pull pin 126 snaps into the aperture 132, the handle 100 is prevent from rotating about the rotation shaft 129. The physician may pull the handle 134 of the pull pin 126 to pull the pin 136 from the aperture 132 to allow the handle 100 to either rotate downwardly to the stowed position or upwardly into a second position, such that the pull pin 126 is received within a second aperture 132.

After the handle 100 has been positioned in the desired vertical position using the release mechanism 122, the button 140 of the rotation actuator 120 may be depressed to permit rotation of the handle 100 about the rotation axis E. Once the handle 100 has been positioned in the desired rotational position relative to the patient's bed, the button 140 can be released to re-engage the rotation actuator 120 to prevent further rotation of the handle 100.

While several examples of the handle 2, 40, 100 are shown in the accompanying figures and described in detail hereinabove, other examples will be apparent to, and readily made by, those skilled in the art without departing from the scope and spirit of the disclosure. Accordingly, the foregoing description is intended to be illustrative rather than restrictive. The invention described hereinabove is defined by the appended claims and all changes to the invention that fall within the meaning and range of equivalency of the claims are to be embraced within their scope.

The invention claimed is:

1. A patient assist handle, comprising:

an outer frame member;

an inner frame member positioned within the outer frame member;

a support post connected to the outer frame member, the support post having a first end and an opposing second end;

a rotation actuator provided on the first end of the support post, the rotation actuator allowing rotation of the patient assist handle about a first rotation axis; and a release mechanism provided on the second end of the support post, the release mechanism allowing rotation of the patient assist handle about a second rotation axis.

2. The patient assist handle as claimed in claim 1, wherein the first rotation axis extends substantially perpendicular to the second rotation axis.

3. The patient assist handle as claimed in claim 1, wherein the first rotation axis extends in a vertical plane and the second rotation axis extends in a horizontal plane.

4. The patient assist handle as claimed in claim 1, wherein the rotation actuator is positioned within the outer frame member.

5. The patient assist handle as claimed in claim 1, wherein the rotation actuator is a depressible button, and wherein, upon applying pressure to the depressible button, rotation of the patient assist handle about the first rotation axis is permitted.

6. The patient assist handle as claimed in claim 1, wherein the rotation actuator is positioned outside of the outer frame member.

7. The patient assist handle as claimed in claim 1, further comprising a mounting bracket connected to the release mechanism, wherein the mounting bracket is configured to attach the patient assist handle to a patient bed.

8. The patient assist handle as claimed in claim 1, wherein the release mechanism comprises:

a spring-biased pull pin; and a positioning plate defining at least one aperture to receive the pull pin.

9. The patient assist handle as claimed in claim 1, wherein the release mechanism comprises:

a plunger;

a plate defining a slot therein;

a locking pin releasably engaged with the plunger; and a slot pin movable within the slot defined in the plate, wherein the plunger is configured to move the locking pin into an unlocked position to permit the slot pin to move within the slot, thereby permitting rotation of the patient assist handle about the second rotation axis.

10. The patient assist handle as claimed in claim 9, wherein the locking pin is spring-loaded so that, upon release of pressure on the plunger, the locking pin moves into a locked position to prevent rotation of the patient assist handle about the second rotation axis.

11. A patient bed, comprising:

an underframe; and a patient assist handle mounted on the underframe, comprising:

an outer frame member;

an inner frame member positioned within the outer frame member;

a support post connected to the outer frame member, the support post having a first end and an opposing second end;

a rotation actuator provided on the first end of the support post, the rotation actuator allowing rotation of the patient assist handle about a first rotation axis; and a release mechanism provided on the second end of the support post, the release mechanism allowing rotation of the patient assist handle about a second rotation axis.

12. The patient bed as claimed in claim 11, wherein the first rotation axis extends substantially perpendicular to the second rotation axis.

13. The patient bed as claimed in claim 11, wherein the first rotation axis extends in a vertical plane and the second rotation axis extends in a horizontal plane.

14. The patient bed as claimed in claim 11, wherein the rotation actuator is positioned within the outer frame member.

15. The patient bed as claimed in claim 11, wherein the rotation actuator is a depressible button, and wherein, upon applying pressure to the depressible button, rotation of the patient assist handle about the first rotation axis is permitted.

16. The patient bed as claimed in claim 11, wherein the rotation actuator is positioned outside of the outer frame member.

17. The patient bed as claimed in claim 11, further comprising a mounting bracket connected to the release mechanism, wherein the mounting bracket is configured to attach the patient assist handle to a patient bed.

18. The patient bed as claimed in claim 11, wherein the release mechanism comprises:

a spring-biased pull pin; and a positioning plate defining at least one aperture to receive the pull pin.

19. The patient bed as claimed in claim 11, wherein the release mechanism comprises:

a plunger;

a plate defining a slot therein;

a locking pin releasably engaged with the plunger; and a slot pin movable within the slot defined in the plate, wherein the plunger is configured to move the locking pin into an unlocked position to permit the slot pin to move within the slot, thereby permitting rotation of the patient assist handle about the second rotation axis.

20. The patient bed as claimed in claim 19, wherein the locking pin is spring-loaded so that, upon release of pressure on the plunger, the locking pin moves into a locked position to prevent rotation of the patient assist handle about the second rotation axis.

21. The patient assist handle as claimed in claim 1, wherein the inner frame member is configured to be grasped by a patient to move the patient from a lying position into a sitting position.

22. The patient bed as claimed in claim 11, wherein the inner frame member is configured to be grasped by a patient to move the patient from a lying position into a sitting position.

* * * * *